114-253 MECH SR
7/12/83 XR 4,392,833

United States Patent [19]
Hayden

[11] 4,392,833
[45] Jul. 12, 1983

[54] COMBINED SINGLE AND DOUBLE WATER SKI TOW BAR

[76] Inventor: Gary N. Hayden, 5479 Mill Creek Blvd., Youngstown, Ohio 44512

[21] Appl. No.: 294,480

[22] Filed: Aug. 20, 1981

[51] Int. Cl.[3] ..... A63C 15/06
[52] U.S. Cl. ..... 441/69; 16/111 R; 16/114 R; 114/253
[58] Field of Search ..... 441/68, 69; 114/253; 440/34; D21/230, 196, 197; 273/81 R; 272/61, 63, 67, 122, 123, 134, 144; 16/111 R, 114 R, DIG. 12, DIG. 18, DIG. 19

[56] References Cited

U.S. PATENT DOCUMENTS

| | | | |
|---|---|---|---|
| 1,536,048 | 5/1925 | Alastalo | 272/122 |
| 3,092,068 | 6/1963 | Brownson | 441/69 |
| 3,122,609 | 2/1964 | Moore | 114/253 |
| 3,196,825 | 7/1965 | Spurlock | 441/69 |
| 3,219,007 | 11/1965 | Kiefer | 441/69 |

FOREIGN PATENT DOCUMENTS

| | | | |
|---|---|---|---|
| 1352937 | 1/1964 | France | 16/111 R |
| 1227230 | 4/1971 | United Kingdom | 441/69 |

*Primary Examiner*—Trygve M. Blix
*Assistant Examiner*—Stephen P. Avila
*Attorney, Agent, or Firm*—Harpman & Harpman

[57] ABSTRACT

A water ski tow bar is arranged to form a single tow bar or handle for a water skier being towed by a boat or the like and separable into two tow bars or handles which may be used by the water skier being towed by the same boat.

1 Claim, 5 Drawing Figures

FIG. 1
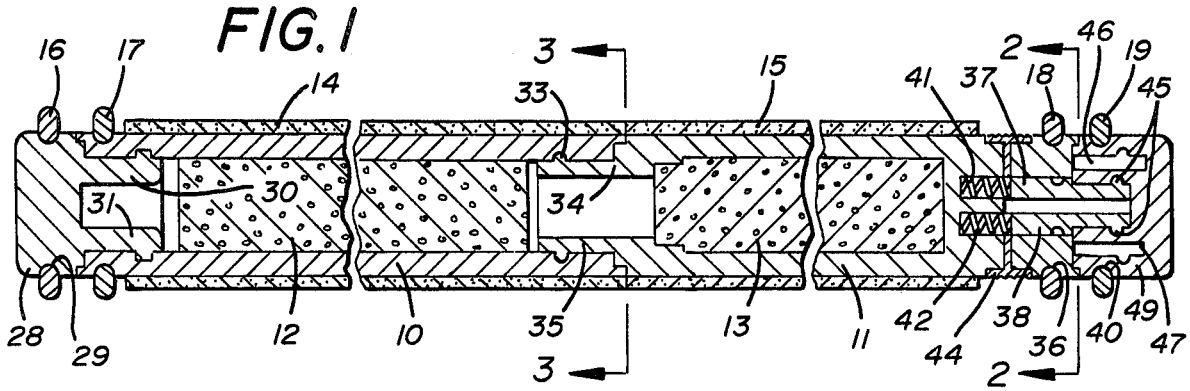
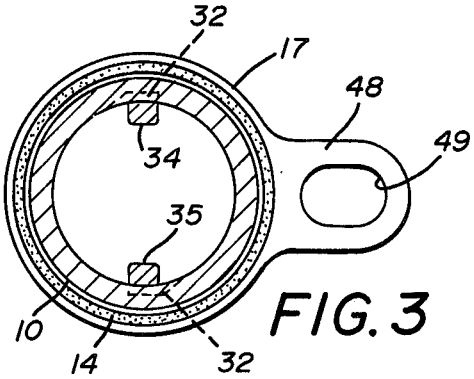
FIG. 3
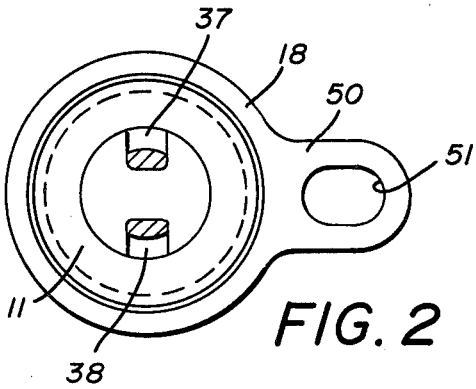
FIG. 2
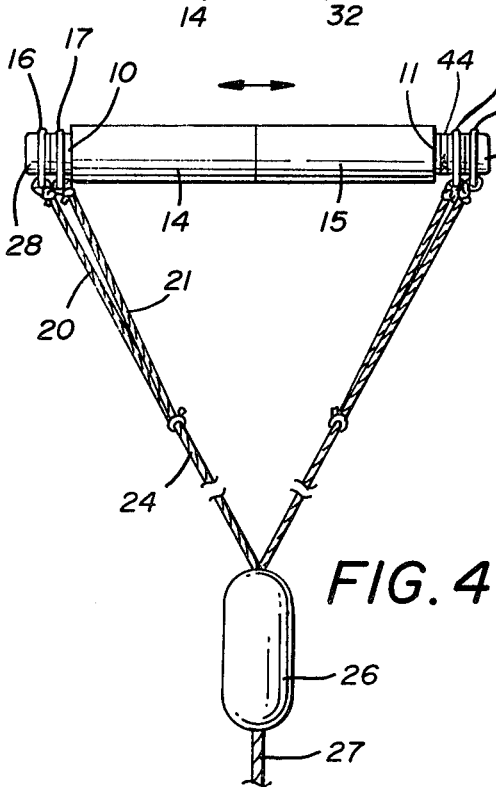
FIG. 4
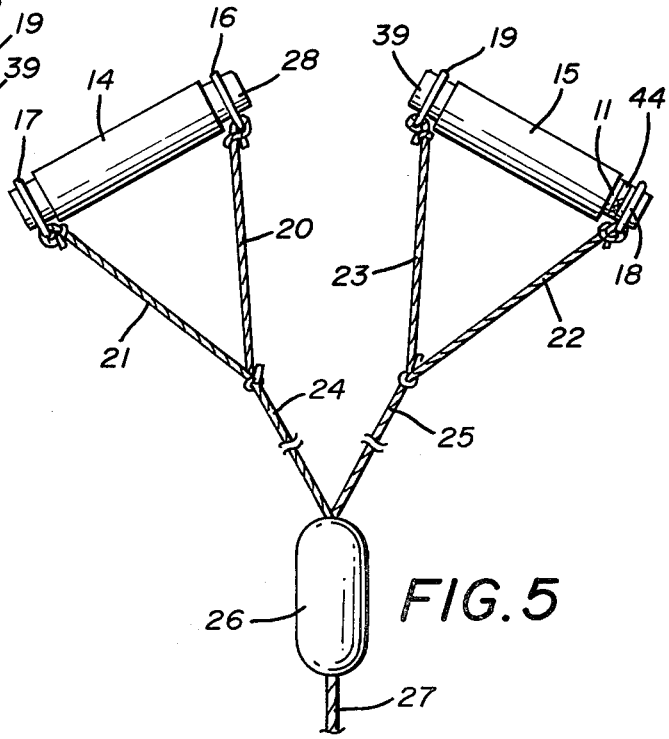
FIG. 5

COMBINED SINGLE AND DOUBLE WATER SKI TOW BAR

BACKGROUND OF THE INVENTION (1) Technical Field

This invention relates to water skiing apparatus such as used in the sport of water skiing.

(2) Description of the Prior Art

Prior devices have comprised single tow bars or handles affixed to a tow rope which in turn is attached to a towing boat. U.S. Pat. No. 3,122,609 shows a communication means for skiing apparatus in which a tow bar or handle is formed in separable sections, one of which comprises an electronic microphone which is connected by wire running along the towing cable or rope to the towing boat.

In U.S. Pat. No. 3,122,609, four separate sections of the tow rope are attached permanently to the tow bar or handle, two of which are always midway between the ends thereof and the device, with or without the microphone and its associated wiring system is awkward to use and incapable of being used as two tow bars for a skier behind the same boat. The present invention when used as a single tow bar or handle by a single water skier assumes the conventional tow bar or handle configuration and has all of the desirable characteristics thereof and when separated into two tow bars or handles forms two independent practical, useful and convenient tow bars or handles.

SUMMARY OF THE INVENTION

A combined single and double water ski tow bar comprises a pair of elongated cylindrical body members detachably affixed to one another in end to end relation to form a conventional appearing single water ski tow bar having connecting ropes attached to its ends and leading to a tow rope which is in turn attached to a towing boat or the like. The tow bar is formed of two portions with two removable caps, the connecting ropes being attached to the portions of the tow bar and the caps respectively, so that when the portions of the tow bar are detached, the caps from the outer opposite ends thereof may be removed and affixed to the inner ends thereof thus moving the connecting ropes to the conventional attachment points as necessary in providing stability in the tow bar when the same is held by a water skier and the water skier pulled along thereby. The arrangement of the two portions of the tow bar and the removable and reattachable end caps to which the tow ropes are attached is novel in the art.

DESCRIPTION OF THE DRAWINGS

FIG. 1 is a cross sectional side elevation of the tow bar;

FIG. 2 is an enlarged cross section on line 2—2 of FIG. 1;

FIG. 3 is an enlarged cross section on line 3—3 of FIG. 1;

FIG. 4 is a plan view of the tow bar in its single skier configuration with portions of the tow ropes broken away; and FIG. 5 is a plan view of the tow bar in its double configuration with portions of the tow ropes broken away.

DESCRIPTION OF THE PREFERRED EMBODIMENT

In the form of the invention chosen for illustration herein, the combination single and double water ski tow bar comprises a pair of cylindrical body members 10 and 11 respectively, each of which has a major portion of its interior filled with buoyant foam 12 and 13 respectively and each of the body members 10 and 11 has an exterior vinyl cover 14 and 15 respectively. The tow bar in its single water skier configuration is seen in plan view in FIG. 4 of the drawings and in cross sectional elevation in FIG. 1 of the drawings.

By referring thereto, it will be observed that there are rope connecting rings 16 and 17 on the left end of the tow bar and secondary rope connecting rings 18 and 19 on the right end of the tow bar. Ropes 20 and 21 are connected to the rings 16 and 17 respectively and ropes 22 and 23 are connected to the rings 18 and 19 respectively. The ropes 20 and 21 are connected to a single rope 24 and the ropes 22 and 23 are connected to a single rope 25 and both the ropes 24 and 25 are directed through a float 26 where they are connected to a single tow rope 27.

It will be seen that in the configuration illustrated in FIG. 4, the combined single and double water ski tow bar is conventional in appearance and may be used by a water skier in a conventional manner.

By referring again to FIG. 1 of the drawings, it will be seen that the left end of the cylindrical body member 10 is arranged to receive a cap 28 which has an annular groove 29 in which the rope connecting ring 16 is movably secured and that the cap 29 is provided with a pair of projecting extensions 30 and 31 arranged in spaced relation to one another and engagable in the open end of the cylindrical body member 10. The projecting extensions 30 and 31 and the inner wall of the cylindrical body member 10 have matching configurations 32 arranged to secure the cap 28 to the cylindrical body member 10 in a snap-like action from whence it may be removed by partial rotation of the projecting extensions 30 and 31 as will occur to those skilled in the art.

The opposite or right end of the cylindrical body member 10 has appropriate configurations 33 matching those of the configurations 32 so that the cap 28 upon being removed from the left end of the cylindrical body member 10 can be snapped into position on the right end of the cylindrical body member 10 as shown in FIG. 5 of the drawings.

By referring again to FIG. 1 of the drawings, it will be seen that the cylindrical body member, which forms the right half of the combination single and double water ski tow bar when it is in single configuration has a pair of spaced outwardly positioned extensions 34 and 35 which are of the same configuration as the projecting extensions 30 and 31 which as hereinbefore described are formed on the removable and replaceable cap 28. The extensions 34 and 35 normally hold the cylindrical body member 11 in end to end firmly affixed relation to the cylindrical body member 10 as seen in FIGS. 1 and 4 of the drawings and by rotating the cylindrical body members 10 and 11 oppositely, the configurations 32 and 33 will disengage and permit the tow bar to become a double tow bar.

The other or right end of the cylindrical body member 11 extends beyond the vinyl covering 15 and has an annular groove 36 therein in which the rope connecting ring 18 is movably secured. A pair of fingers 37 and 38 are movably positioned in matching bores in the projecting end of the cylindrical body member 11 and provide means by which a secondary cap 39 may be detachably secured to the cylindrical body member 11. The cap 39 has an annular groove 40 therein in which the rope connecting ring 19 is movably secured. The movable fingers 37 and 38 are normally biased outwardly by springs 41 and 42 and detents 43 are provided to hold the fingers 37 and 38 inwardly of the end of the cylindrical body member 11 by registry with a rotatable ring lock 44, the outer surface of which is knurled so that it can be rotated by the water skier to secure the fingers 37 and 38 when desired. The outer ends of the fingers 37 and 38 have configurations 45 thereon which register in matching configurations in the cap 39 so that the cap 39 may be held in firm secured position on the outermost end of the cylindrical body member 11 as shown in FIG. 1 and FIG. 4 of the drawings. In such position, the rope connecting rings 16 and 17 will be located at the left end of the cylindrical body member 10 and the rope connecting rings 18 and 19 will be located at the right end of the cylindrical body member 11.

When the single form of the water ski tow bar is changed to its double form, the cylindrical body members 10 and 11 are rotated relative to one another sufficiently to detach the locking configurations 32 and 33 as heretofore described, the cap 28 is removed in a similar action from the left end of the cylindrical body member 10 and applied to the right end thereof and the cap 39 is removed from the right end of the cylindrical body member 11, the fingers 37 and 38 retracted and locked and the cap 39 applied to the left end of the cylindrical body member 11 with the members 34 and 35 engaged in matching bores 46 and 47 respectively formed in the cap 39. The cap 39 upon being partially rotated will become locked in desired position so that the double water ski tow bar seen in FIG. 5 is thus formed.

By referring now to FIG. 3 of the drawings, it will be seen that the rope connecting ring 17 has an extension 48 on one portion of its periphery and an eyelet 49 formed therein so that the rope 21 can be attached thereto as shown in FIGS. 4 and 5 of the drawings.

By referring to FIG. 2 of the drawings, it will be seen that the rope connecting ring 18 has an extension 50 thereon with an eyelet 51 therein so that the rope 22 may be attached thereto as seen in FIGS. 4 and 5 of the drawings.

It will thus be seen that a combined single and double water ski tow bar has been disclosed which may be readily changed from its single configuration to a double configuration and that in both configurations the tow bar is practical, efficient, and easy and convenient to use by a water skier.

Having thus described my invention what I claim is:

1. An improvement in a water ski tow device comprising a tow rope for attachment at one end to a towing boat, said tow rope having four separate sections at its opposite end and a tow bar for a skier attached to said four sections of the tow rope, said tow bar comprising a pair of elongated body members, each having first and second ends, means on said first ends detachably joined to one another so as to position said elongated body members in end to end assembled relation, detachable members on the outer opposite second ends of said elongated body members, said improvement comprising means attaching said four end sections of said tow rope to said elongated body members and said detachable members respectively, said means comprising two of said four sections of said tow rope being attached to said detachable members and two of said four sections of said tow rope being attached to said outer opposite second ends of said elongated body members adjacent said detachable members, said detachable members when detached from said outer opposite second ends of said elongated body members being engagable with said means on said first ends of said elongated body members whereby two tow bars, each having two of said four sections of said tow rope attached to its ends may be formed from said tow bar.

* * * * *